US007081046B2

(12) United States Patent
Watson

(10) Patent No.: US 7,081,046 B2
(45) Date of Patent: Jul. 25, 2006

(54) SANDING MACHINE SUPPORTING REMOVABLE SIDE EXTENSIONS

(76) Inventor: Adam DeWain Watson, 7A8 Park Shore Dr., Naples, FL (US) 34103

( * ) Notice: Subject to any disclaimer, the term of this patent is extended or adjusted under 35 U.S.C. 154(b) by 0 days.

(21) Appl. No.: 10/991,032

(22) Filed: Nov. 17, 2004

(65) Prior Publication Data

US 2005/0124272 A1 Jun. 9, 2005

Related U.S. Application Data

(63) Continuation-in-part of application No. 10/726,804, filed on Dec. 3, 2003.

(51) Int. Cl.
*B24B 23/00* (2006.01)
*B24D 15/00* (2006.01)
*B24B 55/06* (2006.01)

(52) U.S. Cl. ..... 451/356; 451/524

(58) Field of Classification Search ..... 451/351, 451/356, 523, 524
See application file for complete search history.

(56) References Cited

U.S. PATENT DOCUMENTS 4,091,576 A * 5/1978 Hutchins ..... 451/356
4,158,935 A 6/1979 Robert
4,202,140 A 5/1980 Alessio
4,228,620 A * 10/1980 Hutchins ..... 451/356
4,302,910 A 12/1981 Tschacher
4,381,628 A 5/1983 Dicke
4,527,360 A 7/1985 Dicke
4,686,797 A 8/1987 Hoffman
4,729,195 A 3/1988 Berger
4,759,155 A 7/1988 Shaw
4,779,385 A 10/1988 Reiter
4,920,702 A 5/1990 Kloss
5,001,869 A 3/1991 Hutchins
5,007,206 A 4/1991 Paterson
5,123,216 A 6/1992 Kloss
5,144,774 A * 9/1992 Conboy ..... 451/356
5,283,988 A 2/1994 Brown
5,419,737 A 5/1995 Brazell et al.
5,879,227 A * 3/1999 Martin et al. ..... 451/356
5,885,145 A 3/1999 O'Mara
6,186,878 B1 * 2/2001 Takizawa et al. ..... 451/357
6,347,985 B1 2/2002 Loveless
6,379,236 B1 * 4/2002 Takizawa et al. ..... 451/490
6,447,383 B1 9/2002 Oda et al.
6,454,640 B1 9/2002 Siedler et al.
6,468,141 B1 10/2002 Conboy et al.
6,514,131 B1 2/2003 Reich et al.
6,659,851 B1 * 12/2003 Takahashi et al. ..... 451/356

FOREIGN PATENT DOCUMENTS

DE 2048649 4/1972
EP 0 404 133 B1 6/1990

* cited by examiner

*Primary Examiner*—Eileen P. Morgan
(74) *Attorney, Agent, or Firm*—Timothy P OHagan

(57) ABSTRACT

A joint compound sanding machine imparting an oscillating motion on an abrasive within a sanding plane and on a removable abrasive extension comprises a hand held housing and an oscillating base. The base is coupled to the hand held housing by a motor. The base comprises a bottom surface defining the sanding plane, a clamp for securing the abrasive against the bottom surface, and a mounting for securing the removable abrasive extension to the base. The motor is coupled between the hand held housing and the base for imparting the oscillating motion, with respect to the hand held housing, on the base to oscillate both the abrasive and the removable abrasive extension.

10 Claims, 9 Drawing Sheets

SANDING MACHINE SUPPORTING REMOVABLE SIDE EXTENSIONS

CROSS REFERENCE TO RELATED APPLICATIONS

The present application is a continuation in part of U.S. patent application Ser. No. 10/726,804 entitled Joint Compound Sander filed on Dec. 3, 2003 the contents of this patent application are incorporated herein.

TECHNICAL FIELD

The present invention relates to portable electric hand tools, and in particular to a portable electric sanding machine useful for capturing dust generating when sanding joint compound and useful for sanding joint compound in acute angle corners.

BACKGROUND OF THE INVENTION

When installing drywall in a facility, large panels of drywall are nailed or screwed to structural studs. Each nail or screw leaves a recess in the surface of the dry wall panel and gaps exist between adjacent dry wall panels. Typically the gaps between panels are covered with a tape and a joint compound is used to: i) fill the recesses in the surface caused by the nail or screw; ii) cover and blend the surface of the tape to the surface of the panels; and iii) fill remaining damage and imperfections in the surface of the panels.

The joint compound is applied in a wet state. After the joint compound hardens and dries, it is sanded such that a smooth surface is formed across multiple dry wall panels. Traditional sanding paper typically become clogged with joint compound dust which renders the sanding paper ineffective quite quickly. Porous sanding screens supported by a rubber or foam sanding block are an improvement over traditional sanding paper as the user may periodically flex the screen with respect to the block to remove joint compound dust clogging the screen. While this solution resolves the clogging problem, hand sanding with a screen remains tedious and the repetitive task of removing clogged joint compound from the screen is time consuming at best.

Existing hand held power sanders are also useful for sanding joint compound, however several problems exist with using existing power sanders. First, if the power sander can only accommodate traditional sanding paper, the sanding paper will become clogged with joint compound dust very quickly rendering it ineffective.

Second, a typical sander only supports sandpaper in a single plane and is therefore impractical for sanding joint compound applied in a corner wherein two drywall panels meet at an acute angle.

What is needed is portable powered dry wall sanding tool that does not suffer the disadvantages of known systems.

SUMMARY OF THE INVENTION

A first aspect of the present invention is to provide a joint compound sanding machine for imparting an oscillating motion on an abrasive screen within a sanding plane and on a removable abrasive extension.

The sanding machine comprises a hand held housing, a base, and a motor. The base comprises a bottom surface defining the sanding plane and positioning the abrasive screen within the sanding plane. The base further comprises a clamp for securing the abrasive screen against the bottom surface and a mounting for securing the removable abrasive extension to the base.

The motor is coupled between the hand held housing and the base for imparting the oscillating motion, with respect to the hand held housing, on the base to oscillate both the abrasive screen secured to the base and the removable abrasive extension secured to the base.

In more detail, the bottom surface comprises a left edge and a right edge. The left edge and right edge are parallel and extend in (e.g. define) a longitudinal direction.

In a first implementation example, the mounting secures the removable abrasive extension to the base such that a first planar abrasive extension surface of the removable abrasive extension is parallel to the longitudinal direction.

In a second implementation example, the mounting comprises a left edge mounting for securing the removable abrasive extension adjacent to the left edge and a right edge mounting for securing the removable abrasive extension adjacent to the right edge. In this second implementation example (like the first implementation example) the mounting may further secure the removable abrasive extension to the base such that a first planar abrasive extension surface of the removable abrasive extension is parallel to the longitudinal direction.

In any implementation of the present invention, the removable abrasive extension may comprise both a first planar abrasive extension surface and a second planar abrasive extension surface. As such the mounting secures the removable abrasive extension such that each of a first planar abrasive extension surface and a second planar abrasive extension surface, positioned perpendicular to each other, are each positioned parallel to the longitudinal direction.

Further, the joint compound sanding machine may include the removable abrasive extension. In more detail, the removable abrasive extension comprises a rigid frame which defines both the first planar abrasive extension surface and the second planar abrasive extension surface and imparts the oscillating motion to both the first planar abrasive extension surface and the second planar abrasive extension surface.

The removable abrasive extension may further include a malleable layer positioned between the rigid frame and an abrasive screen. The malleable layer may be formed of a rubber or sponge material on each of the first planar abrasive extension surface and the second planar abrasive extension surface.

For a better understanding of the present invention, together with other and further aspects thereof, reference is made to the following description, taken in conjunction with the accompanying drawings. The scope of the present invention is set forth in the appended claims.

DETAILED DESCRIPTION OF THE EXEMPLARY EMBODIMENTS

Figure 1A:
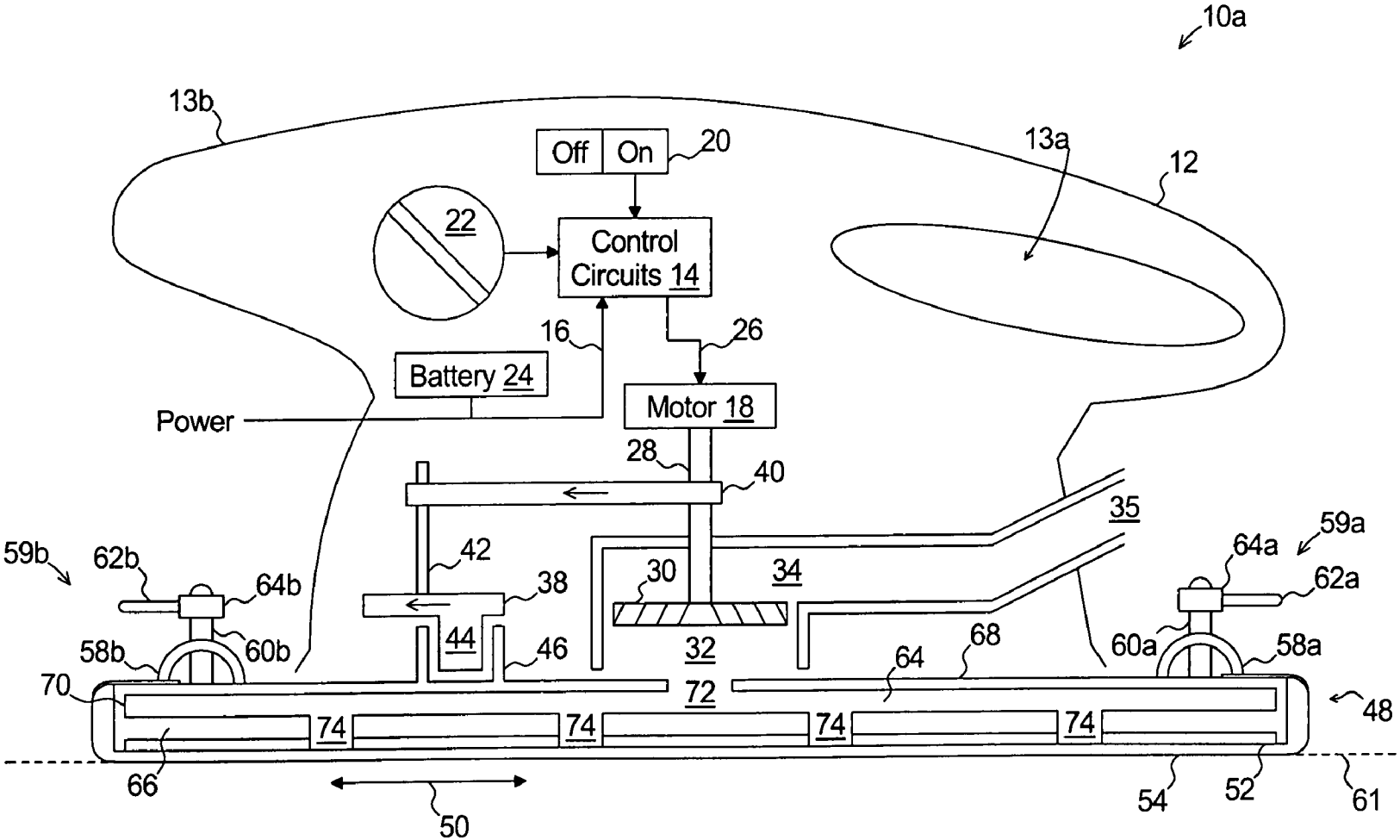
FIG. 1*a* shows a side view, partially cut away, of a first exemplary embodiment of a joint compound sander in accordance with the present invention.

The present invention will now be described in detail with reference to the drawings. In the drawings, each element with a reference number is similar to other elements with the same reference number independent of any letter designation following the reference number. In the text, a reference number with a specific letter designation following the reference number refers to the specific element with the number and letter designation and a reference number without a specific letter designation refers to all elements with the same reference number independent of any letter designation following the reference number in the drawings.

First Exemplary Sanding Machine Structure

FIG. 1*a* shows a side view, partially cut away, of a first exemplary structure of a joint compound sanding machine 10*a* in accordance with the present invention. The joint compound sander 10*a* comprises a housing 12 formed of a plastic or other durable material and a base assembly 48.

In addition to being a chassis and supporting the elements discussed herein, the housing 12 forms the external surface of the sander 10*a* and is shaped with one or more handles 13*a* and 13*b* for easy operation by an operator.

Within the housing 12 is a control circuit 14. The control circuit 14 receives operating power 16 from a remote power source (such as through an electrical cable or from a battery 24). The control circuit 14 provides controlled power 26 to an electric motor 18 in accordance with input control signals provided by an on/off switche 20 and a variable speed control rheostat 22.

The motor 18 is secured to the housing 12 and includes a spinning shaft 28. The spinning shaft 28 is coupled to, and rotates, a dust collection fan 30. The dust collection fan 30 may be an impeller fan which includes an inlet 32 at its center and, when spinning, forces dust and air from the inlet 32 to an exhaust manifold 34 at the periphery of the fan 30. The exhaust manifold 34 vents outside the housing through a vacuum port 35 to a dust collection bag or external vacuum dust collection system. Alternatively, the fan 30 may be a propeller fan including the inlet 32 located below a plane defined by a spinning propeller fan 30 and the exhaust manifold 34 above the plane.

The spinning shaft 28 also couples to an idler 38 driven by a drive belt 40. The idler 38 is secured to the housing 12 and rotates about a shaft 42 which is parallel to the motor shaft 28. The idler includes an off axis (e.g. concentric) drive lug 44 which rotates in a circle about an axis defined by shaft 42 when the idler 38 is rotated. As will be discussed in more detail with respect to FIG. 2, the drive lug 44 fits within a lateral slot 46 of the base 48 and causes the base 48 to oscillate in a longitudinal direction 50 at the same frequency at which the idler 38 rotates.

The base 48 includes a bottom surface 52 which supports a joint compound sanding screen 54 in a sanding plane 61 for sanding a surface and each of first clamp assembly 59*a* and a second clamp assembly 59*b* for securing the joint compound sanding screen 54 to the bottom surface 52 in the sanding plane 61.

In a traditional power sander with a dust collection skirt, clamps for holding the sandpaper are typically spring biased clamps with a small size such that the clams fit beneath a dust collection skirt. The clamp assemblies 59*a* and 59*b* differ from traditional power sander spring clamps in both size and operation. Because of the novel dust collection apparatus of the present invention (discussed below), there exists no dust collection skirt to limit the size of the clamp assemblies 59*a* and 59*b*.

Figure 5:
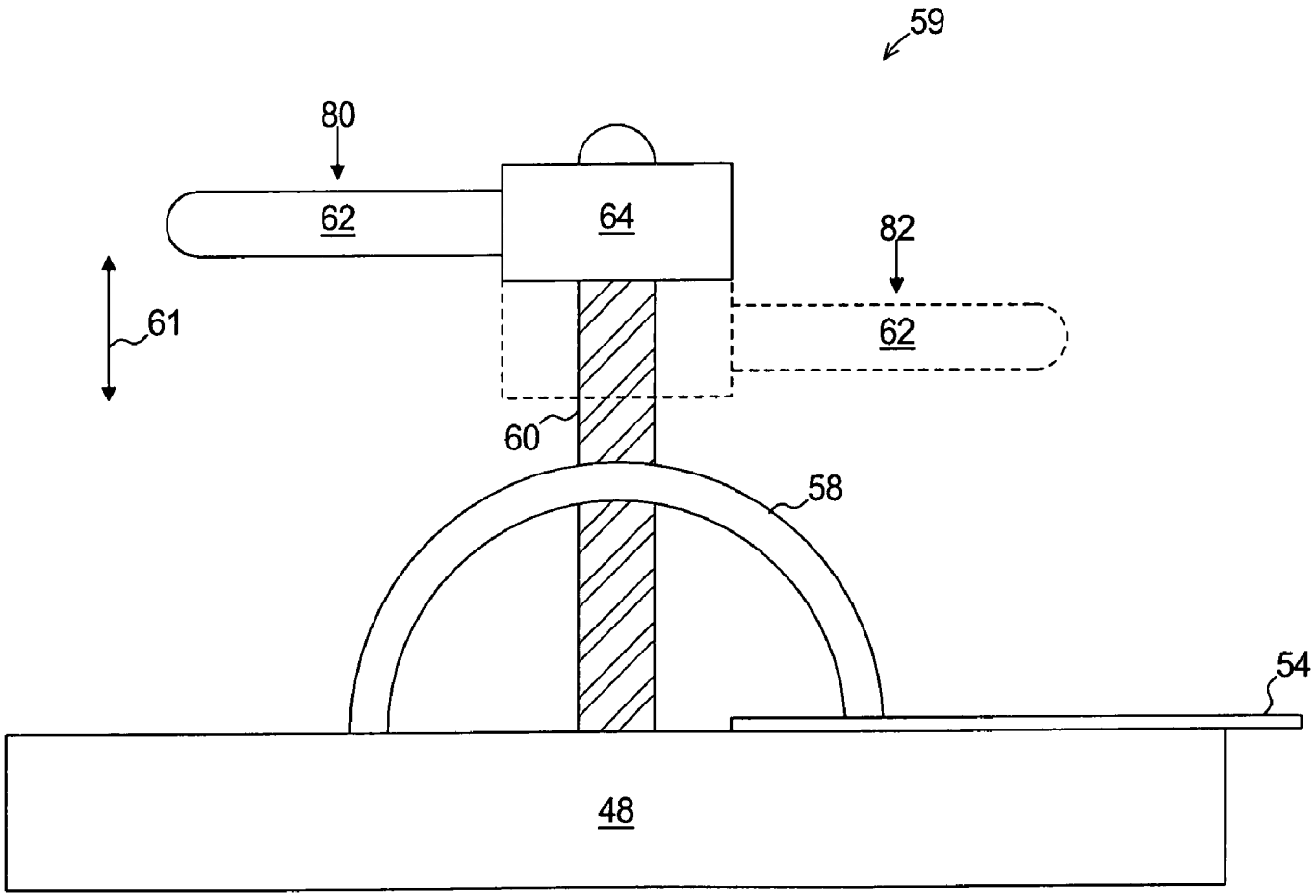
FIG. 5 shows a view of an exemplary clamp assembly in accordance with an embodiment of the present invention.

Referring briefly to FIG. 5 in conjunction with FIG. 1*a*, a more detailed diagram of an exemplary clamp assembly 59 is shown. The clamp assembly 59 includes a clamp 58 which is secured against a top surface of the base 48 and thereby traps the sanding screen 54 there between. The portion of the top surface of the base 58 against which the clamp assembly 59 traps the sanding screen 54 is a portion that extends outward from the housing 12 in the longitudinal direction 50 to provide adequate clearance for operation of the clamp assembly 59.

The clamp assembly 59 further includes at least one threaded shaft 60 secured to and protruding upward from the base 48 through a hole in the clamp 58. A lever handle or wing nut 62 when in a first position 80 provides for the clamp 58 to be moved in a vertical direction 61 along the threaded shaft 60 to create a space between the clamp 58 and the top surface of the base 48 for inserting or removing a portion of the sanding screen 54. When the lever handle or wing nut 62 is tightened to a second position 82 by rotating the lever handle or wing nut about the threaded shaft 60, the wing nut 62 secures the first clamp 58 against the top surface of the base and clamps the sanding screen 54 there between. It should be appreciated that an increased size of the lever handle or wing nut 62 increases the torque that can be applied by an operator with a fixed amount of "finger" pressure.

Returning to FIG. 1*a*, the base 48 further comprises a vacuum manifold 64 formed above a bottom plate 66. The vacuum manifold 64 may be defined by the bottom plate 66, a top surface 68, and sidewalls 70. A central aperture 72 is positioned to join with the inlet 32 of the fan 30 such when fan 30 is rotated, air and dust within the vacuum manifold 64 is drawn into the fan 30.

FIG. 2*a* shows a perspective view, partially cut away, of an exemplary base 48. Turning to FIG. 2*a* in conjunction with FIG. 1*a*, the sidewalls 70 are at the periphery of the base 48 such that the vacuum manifold 64 extends across the entire base 48 in both the lateral direction 74 and the longitudinal direction 50.

In this exemplary embodiment, both the top surface 68 and the side walls 70 are secured to, and move in conjunction with, the bottom plate 66. However, is envisioned that the top surface 68 and the side walls 70 may be part of the housing 12 (or secured to the housing 12) such that there is relative motion between the side walls 70 and the bottom plate 66.

The bottom plate 66 includes a plurality of dust collection apertures 74. The bottom surface 52 of the bottom plate 66 supports the sanding screen 54 within the sanding plane 61. The bottom surface 52 (shown in plan view in FIGS. 6*a* and 6*b*) includes a plurality of mesas 78 and channels 80 whereby the mesas 78 define the sanding plane 61 and support the sanding screen 54 within the sanding plane 61. Each of the channels 80 is interspaced between mesas 78 to form a duct behind the sanding screen 54 for the flow of air and dust towards a dust collection aperture 74.

Figure 6A:
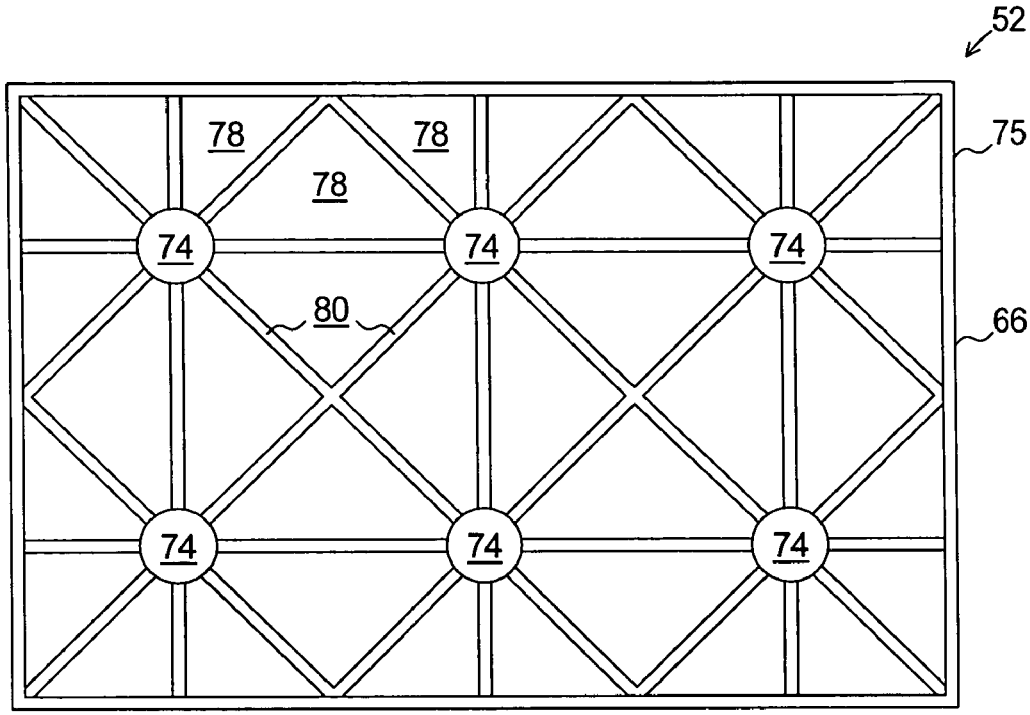
FIG. 6*a* shows a plan view of an exemplary bottom surface of a base in accordance with one embodiment of the present invention.

Referring briefly to FIG. 6*a*, a first exemplary pattern of mesas 78 and channels 80 is shown. Each channel 80 may be a 1/16 inch wide and 1/16 inch deep channel 80 formed in a planar surface thereby defining each mesa 78 and forming bottom surface 52. In this first exemplary embodiment, each channel 80 extends in a radial direction from a dust collection aperture. The mesa 78 extends around the periphery of the bottom surface 52 to restrict the flow of air into the channels 80 to only that air that has been drawn through the porous joint compound sanding screen 54.

Figure 6B:
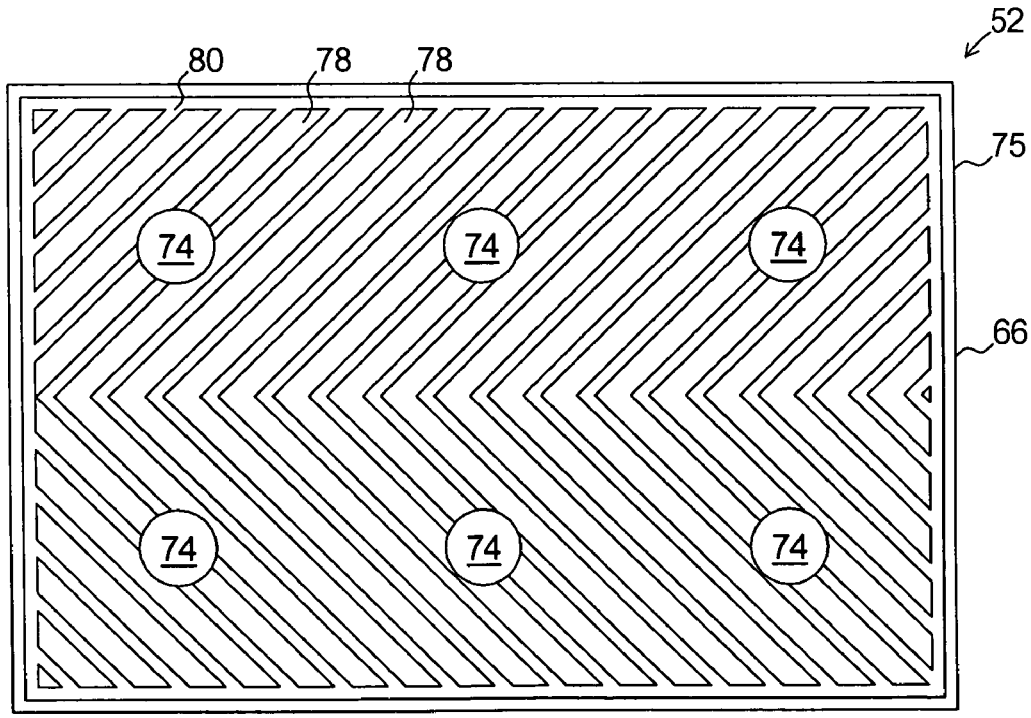
FIG. 6*b* shows a plan view of an exemplary bottom surface of a base in accordance with one embodiment of the present invention.

Referring briefly to FIG. 6*b*, a second exemplary pattern of mesas 78 and channels 80 is shown. Each mesa may be 1/16 inch wide and 1/16 inch in height formed a planar surface defining channels there-between. In this second embodiment, a perimeter mesa 75 may extend around the periphery of the bottom surface 52 to restrict the flow of air into the channels 80 to only that air that has been drawn through the porous joint compound sanding screen 54.

Returning to FIGS. 1*a* and 2*a*, in operation, dust generated by the abrasive sanding screen 54 is drawn through the screen 54, along a channel 80 towards a dust collection aperture 74, through the dust collection aperture 74 into the vacuum manifold 64, through the central aperture 72 and inlet 32 of the fan 30, and then forced, by operation of the fan 30, into the exhaust manifold 34 and into the dust collection bag. By drawing the dust through the screen 54, clogging of the sanding screen 54 by dust becoming trapped in the screen 54 is reduced or eliminated.

In the exemplary embodiment, the base 48 (supporting the sanding screen 54) oscillates in the longitudinal direction 50 with respect to the housing 12. The base includes two tracks 84*a* and 84*b* secured to the base 48. Each track 84 mates with a corresponding track formed in the housing 12 to permit a sliding motion in the longitudinal direction 50 while preventing movement in the lateral direction 74. In the exemplary embodiment, each track may be structured as a linear bearing to prevent excessive friction and heat build up by the linear motion of the base 48 with respect to the housing 12.

The linear motion is caused by the orbital motion of the drive lug 44 within the lateral slot 46. As the idler 38 spins, the off axis drive lug 44 moves in an orbital pattern. The lateral component of the orbital pattern moves the drive lug 44 laterally within the slot 46 while the longitudinal motion of the drive lug 44 moves the slot and the base 48 in the longitudinal direction.

Second Exemplary Sanding Machine Structure

Figure 1B:
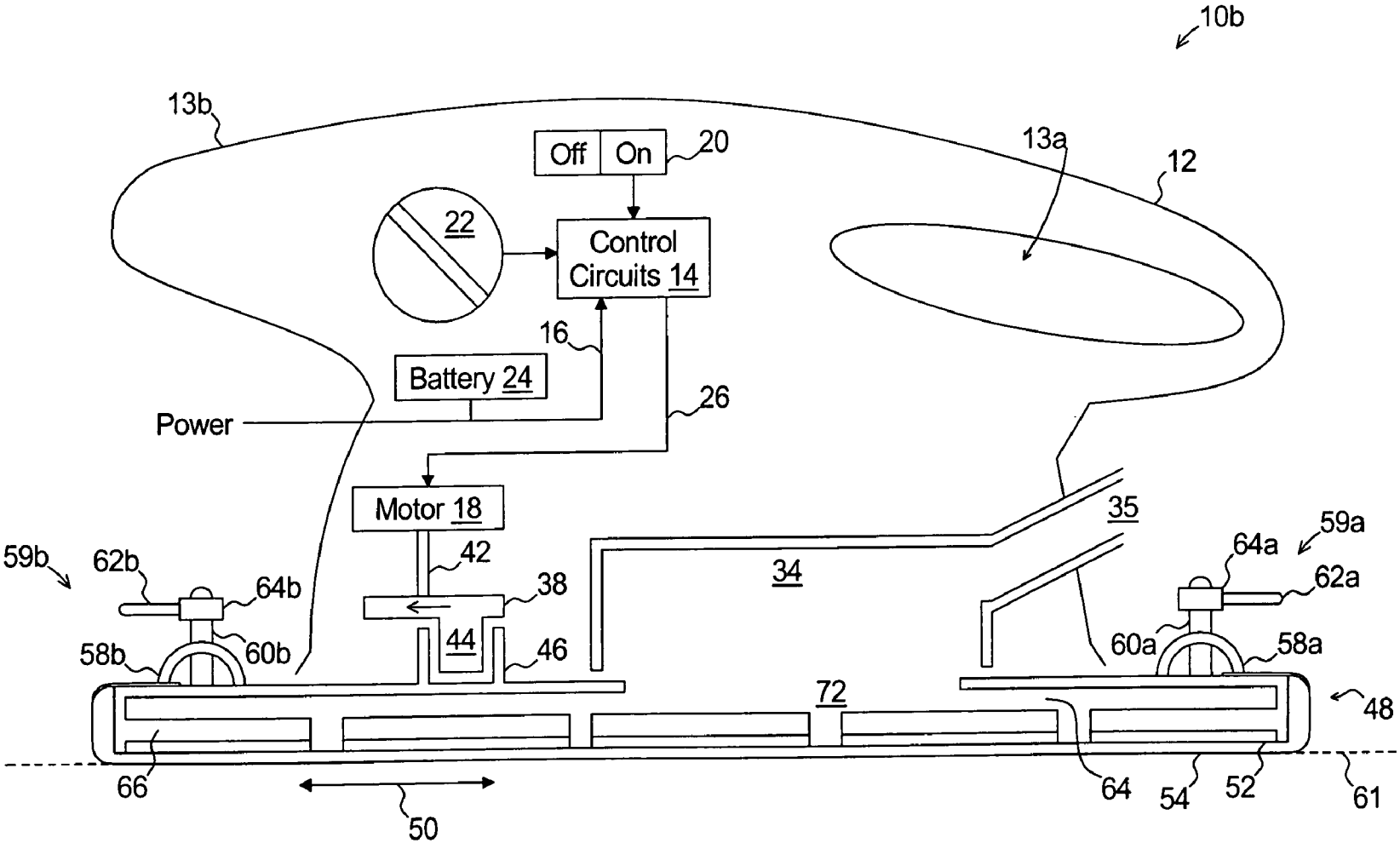
FIG. 1*b* shows a side view, partially cut away, of a second exemplary embodiment of a joint compound sander in accordance with the present invention.

FIG. 1*b* shows a side view, partially cut away, of a second exemplary structure of a joint compound sander 10*b* in accordance with the present invention. The joint compound sander 10*b*, like the first embodiment joint compound sander 10*a* of FIG. 1*a*, comprises a housing 12 which functions as a chassis, forms the external surface of the sander 10*b*, and is shaped to include one or more handles 13*a* and 13*b* for easy operation by an operator.

Within the housing 12 is a control circuit 14. The control circuit 12 receives operating power 16 from a remote power source (such as through an electrical cable or from a battery 24). The control circuit 14 provides controlled power 26 to an electric motor 18 in accordance with input control signals provided by an on/off switched 20 and a variable speed control rheostat 22.

The motor 18 is secured to the housing 12 and includes a spinning shaft 42. The spinning shaft 42 includes an off axis drive lug 44 which rotates in a circle about an axis defined by shaft 42 thereby causing the base 48 to oscillate in a longitudinal direction 50 at the same frequency at which the shaft 42 rotates.

As previously discussed with reference to FIGS. 1*a* and 2, the base 48 includes a vacuum manifold 64 formed above a bottom plate 66. The vacuum manifold 64 may be defined by the bottom plate 66 and a central aperture 72 is positioned to join the vacuum manifold 64 with the exhaust manifold 34. The exhaust manifold 34 is coupled to a vacuum port 35 such that when an external vacuum dust collection system is coupled to the vacuum port 35, dust generated by the abrasive sanding screen 54 is drawn through the screen 54, along a channel 80 towards a dust collection aperture 74, through the dust collection aperture 74 into the vacuum manifold 64, through the central aperture 72 into the exhaust manifold 34 and drawn through the vacuum port 35 towards the external vacuum dust collection system.

Third Exemplary Sanding Machine Structure

Figure 1C:
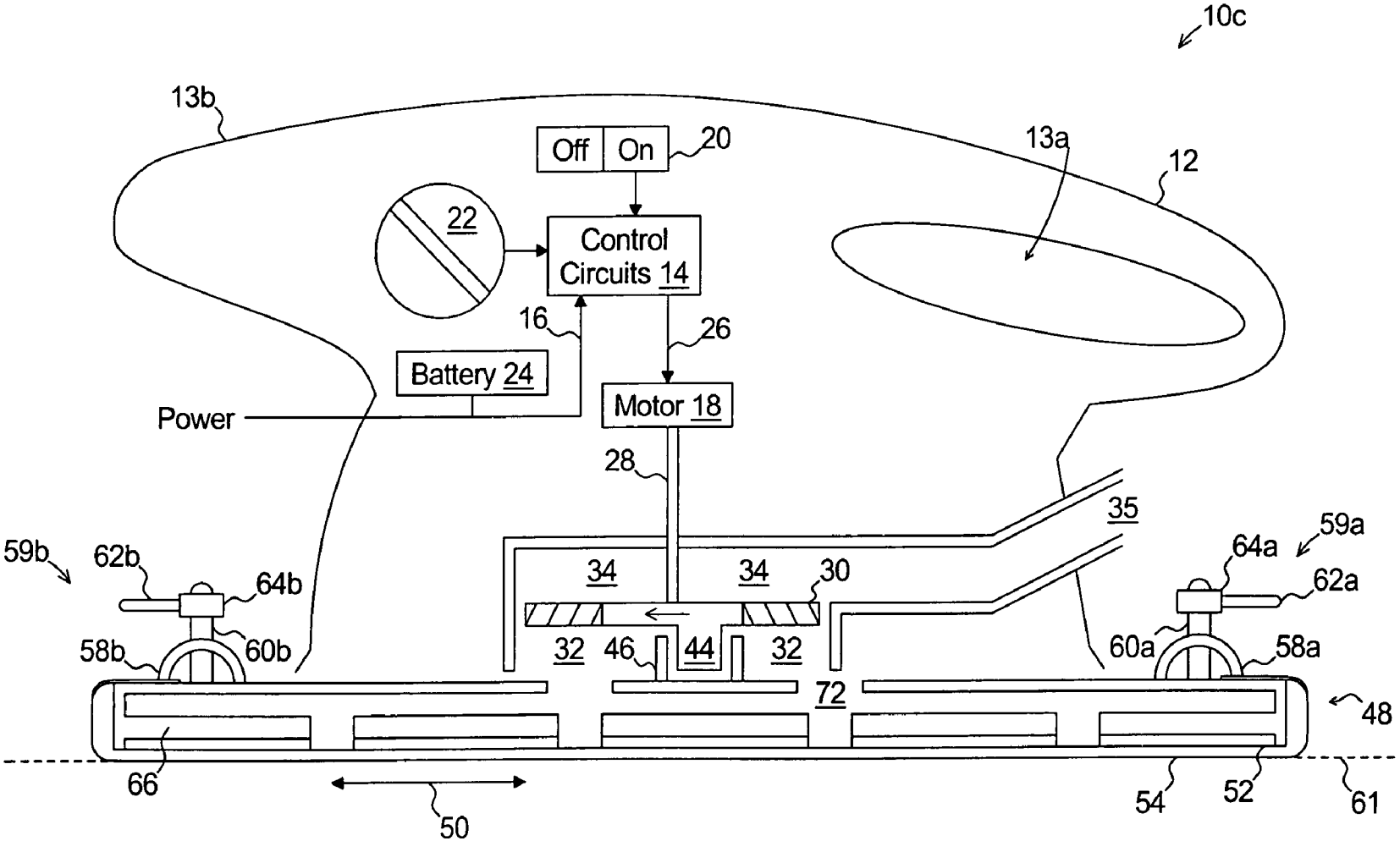
FIG. 1*c* shows a side view, partially cut away, of a third exemplary embodiment of a joint compound sander in accordance with the present invention.

FIG. 1*c* shows a side view, partially cut away, of a third exemplary structure of a joint compound sander 10*c* in accordance with the present invention. The joint compound sander 10*c* differs from the joint compound sander 10*a* in the structure for imparting an oscillating motion on the base 48 with respect to the hand held housing 12.

More specifically, the motor 18 is secured to the housing 12 and includes a spinning shaft 28. The spinning shaft 28 is coupled to, and rotates, both a dust collection fan 30 and an off axis (e.g concentric) lug 44 or bearing.

As discussed with respect to FIG. 1*a*, the dust collection fan 30 forces dust and air from an inlet 32 to an exhaust manifold 34. The exhaust manifold 34 vents outside the housing through a vacuum port 35 to a dust collection bag or external vacuum dust collection system.

The drive lug 44 which rotates in a circle about an axis defined by shaft 28. The drive lug 44 fits within a lateral slot of the base such that when the shaft 28 is rotated, the base oscillates in a longitudinal direction 50 at the same frequency at which the shaft 28 rotates.

The other components of the third exemplary embodiment shown in FIG. 1*c* are similar in structure and function as discussed with respect to FIG. 1*a* with minor variations necessary for implementation.

Alternative Base Plate

Figure 3:
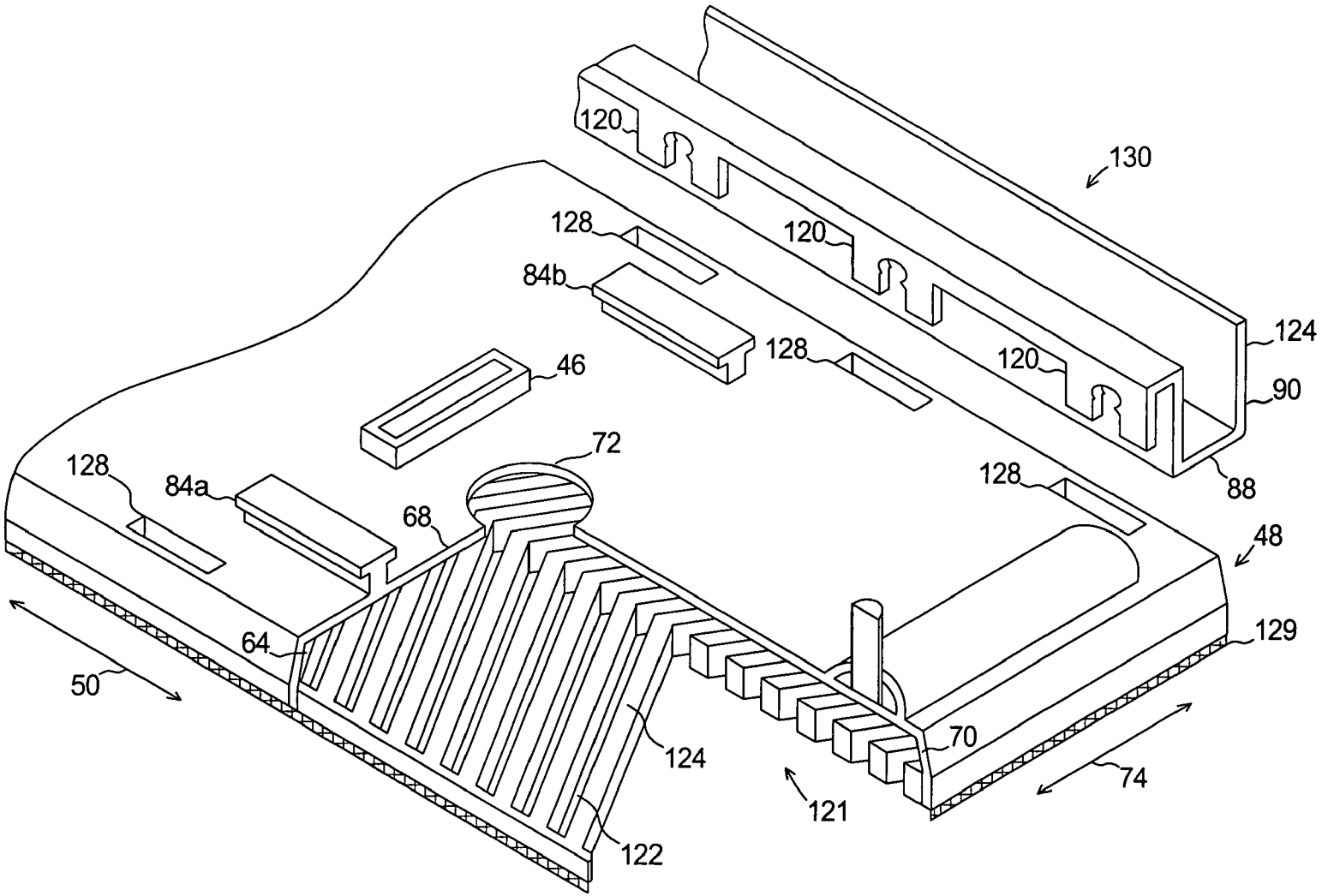
FIG. 3 shows a perspective view, partially cut away, of a second exemplary base and certain components of a joint compound sander in accordance with an exemplary embodiment of the present invention.

FIG. 3 shows structure of a base 48 which includes a base plate structure 121 which is useful for replacing the base plate structure 66 in any of the sanding machine embodiments discussed with respect to FIGS. 1*a*, 1*b*, and 1*c*.

Referring briefly to FIG. 3, the base 48 includes a vacuum manifold 64 formed above the bottom plate 121. The vacuum manifold 64 may be defined by the bottom plate 121, a top surface 68, and sidewalls 70. At least one aperture 72 in the top surface 68 joins with the inlet of a fan 30 (FIG. 1*c* for example) such that when the fan 30 is rotated, air and dust within the vacuum manifold 64 is drawn into the fan 30.

The sidewalls 70 are at the periphery of the base 48 such that the vacuum manifold 64 extends across the entire base 48 in both the lateral direction 74 and the longitudinal direction 50.

Again, in the exemplary embodiment the top surface 68 and the side walls 70 are secured to, and move in conjunction with, the bottom plate 121 but in an alternative embodiment, the top surface 68 and the side walls 70 may be part of the housing 12 such that there is relative motion between the side walls 70 and the bottom plate 121.

The bottom plate 121 includes a plurality of interspaced dust collection channels 122 and supports 124 forming a "grill" pattern. Each of the channels 122 (defined by two adjacent supports 124) is an aperture entirely through the bottom plate 121, extending from the bottom surface 52 of the bottom plate 121 to the vacuum manifold 64. The bottom surface 52 which supports the sanding screen 54 within the sanding plane 61 is formed by the plurality of supports 124. It is envisioned that each channel 122 and each support 124 may be on the order of 1/16 inch wide and the thickness of each support 124 (between the vacuum manifold and the bottom surface 52) may be 1/16 inch.

Abrasive Extensions

To facilitate sanding of joint compound in acute corners, an extension may be coupled to the base such that the motor, in imparting an oscillating motion on the base, imparts the oscillating motion on the abrasive extension.

Figure 2:
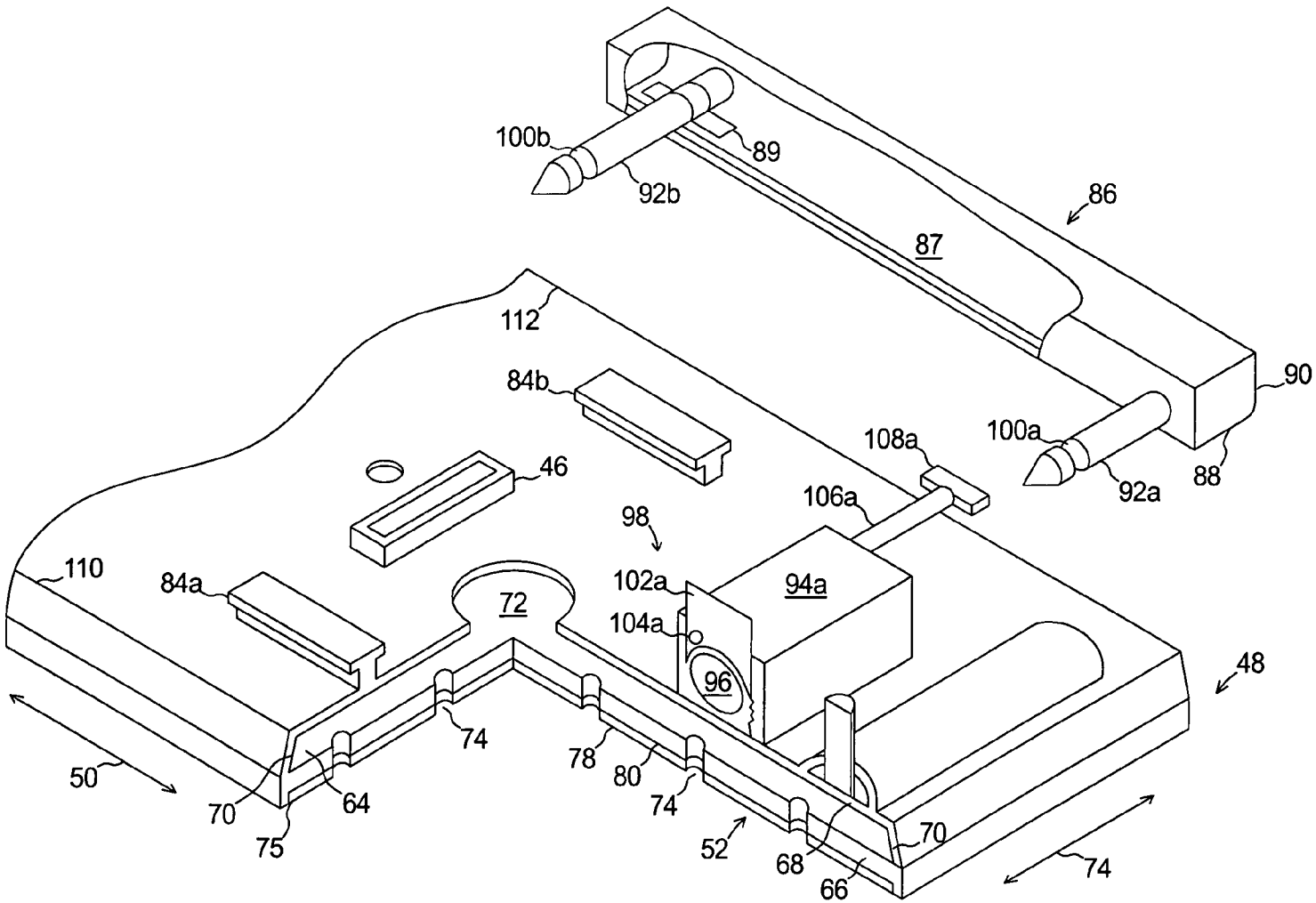
FIG. 2 shows a perspective view, partially cut away, of a first exemplary base and certain components of a joint compound sander in accordance with an exemplary embodiment of the present invention.
Figure 4:
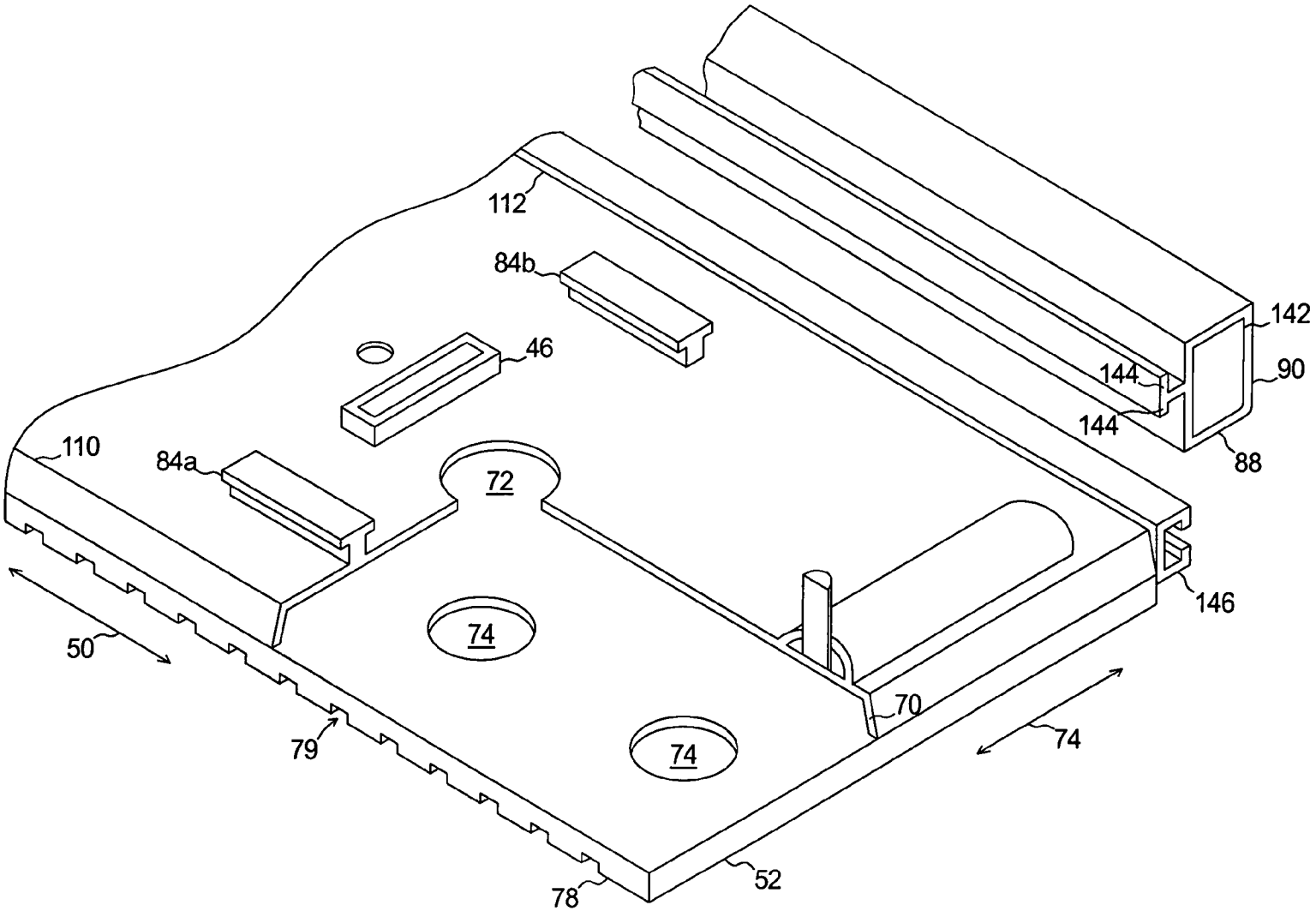
FIG. 4 shows a perspective view, partially cut away, of a third exemplary base and certain components of a joint compound sander in accordance with an exemplary embodiment of the present invention.

FIGS. 2, 3, and 4 each show an alternative embodiment of an abrasive extension and an alternative system for mounting the abrasive extension to the base. It should be appreciated that each of the abrasive extension embodiments is useful with each of the sanding machine structures discussed above and with each of the bottom plate structures discussed above.

Referring to FIG. 2, an abrasive extension 86 is shown in perspective view. The abrasive extension 86 may have a first abrasive extension surface 88 (or support abrasive sanding paper or a sanding screen on its surface to form the first abrasive extension surface 88) and a second abrasive extension surface 90 (or support abrasive sanding paper or a sanding screen on its surface to form the second abrasive extension surface 90). The first abrasive extension surface 88 and the second abrasive extension surface 90 are: i) each planar and perpendicular to each other; and ii) each parallel to the longitudinal direction 50 defined by a left edge and a right edge of the base 48. More specifically, a line defined at the intersection fo the first abrasive extension surface 88 and the second abrasive extension surface 90 is parallel to the longitudinal direction 50. Further yet, one of the first abrasive surface 88 and the second abrasive surface 90 may be parallel to the sanding plane 61 (*Figure* 1*c*) or even coplanar with the sanding plane 61.

The exemplary abrasive extension 86 may mount to the base 48 using two pins 92*a* and 92*b*, each of which secures in a mounting 94 on the top side of the base 48 (only one mounting 94 is shown). As shown in the cut away, a rigid frame 87 defines each of the first abrasive extension surface 88 and the second abrasive extension surface 90 and is secured to the two pins 92*a* and 92*b* by a bracket 89 such that when the pins 92*a* and 92*b* are engaged within a mounting 94 each of the first abrasive extension surface 88 and the second abrasive extension surface 90 oscillate in unison with the pins 92*a* and 92*b* which oscillate in unison with the base 48.

In the exemplary embodiment, the mounting 94 may include a tube 96, with an axis in the lateral direction 74, and a co-axial aperture 96 into which the pin 92 securely fits. Motion of the base (including the tube 96) causes corresponding motion of the extension 86.

The mounting 94 may include a locking mechanism 98 for securing the pin 92 within the tube 96. In the exemplary embodiment, the locking mechanism 98 includes a locking plate 102 for engaging a corresponding locking slot 100 in the pin 92. The locking plate 102 is movable about a hinge point 104 such that it may be moved between a locked position and an unlocked position by rotating the locking plate 102 about the hinge point 104. An extension 106 (such as a rod) may be secured to the locking plate 102 at the hinge point 104 and secure in a tube thereby forming a hinge at the hinge point 104. The extension 106 may include wings 108 for easy twisting of the extension 106 by an operator to move the locking plate 102 between the locked an unlocked position.

In the exemplary embodiment, the locking plate 102 is located within the center of the base (center in the lateral direction 74) such that the extension 86 may be mounted to either the left side 110 or the right side 112 of the base 48.

Referring to FIG. 3, an alternative embodiment abrasive extension 130 is shown in perspective view. Again, the abrasive extension 130 and its system for mounting to base 48 is useful with any of the sanding machine structures of FIGS. 1*a*, 1*b*, and 1*c*, and with any of the embodiments of the base 48 previously discussed.

The abrasive extension 130 is formed of a generally planar rigid material 124 (such as a metal) which includes a plurality of bends to form a frame which defines each of a second abrasive extension surface 90 (or support abrasive sanding paper or a sanding screen on its surface to form the second abrasive extension surface 90), a first abrasive extension surface 88 (or support abrasive sanding paper or a sanding screen on its surface to form the first abrasive extension surface 88), and mounting protrusions (in the form of blades) 120. Again, the first abrasive extension surface 88 and the second abrasive extension surface 90 are: i) each planar and perpendicular to each other; and ii) each parallel to the longitudinal direction 50 defined by a left edge and a right edge of the base 48.

The blades 120 of the rigid material frame 124 may secure within a corresponding mounting slots 128 in the base 48 such that each of the first abrasive extension surface 88 and the second abrasive extension surface 90 oscillate in unison with the base 48.

In the exemplary embodiment, each mounting blade 120 may include structure for being secured within the mounting slot by a spring biased lock (not shown) or other structure for assuring that the abrasive extension 130 is not easily removed from its mount to the base 48 during sanding operations.

It should be appreciated that the mounting blade structure 120 enables the extension 130 to be secured to mounting slots 128 on a left side of the base 48 and to slots 128 on the right side of the base such that the same abrasive extension 130 may be secured to either side.

Referring to FIG. 4, yet another alternative embodiment abrasive extension 140 is shown in perspective view. The abrasive extension 140 and its system for mounting to base 48 is useful with any of the sanding machine structures of FIGS. 1*a*, 1*b*, and 1*c*, and with any of the embodiments of the base 48 previously discussed.

The abrasive extension 140 is formed of a generally rigid material frame 142 (such as a plastic) which is molded or extruded to form a plurality of surfaces which define each of a second abrasive extension surface 90 (or support abrasive sanding paper or a sanding screen on its surface to form the second abrasive extension surface 90), a first abrasive extension surface 88 (or support abrasive sanding paper or a sanding screen on its surface to form the first abrasive extension surface 88), and mounting protrusions (in the form of extended blades) 144. Again, the first abrasive extension surface 88 and the second abrasive extension surface 90 are: i) each planar and perpendicular to each other; and ii) each parallel to the longitudinal direction 50 defined by a left edge and a right edge of the base 48.

The blades 144 of the frame 142 may secure within a corresponding elongated mounting slot 146 formed in (or secured to) the side of the base 48 such that each of the first abrasive extension surface 88 and the second abrasive extension surface 90 oscillate in unison with the base 48.

In the exemplary embodiment, each mounting blades 144 may include structure for being secured within the mounting slot by a spring biased lock (not shown) or other structure for assuring that the abrasive extension 140 is not easily removed from its mount to the base 48 during sanding operations.

Again, it should be appreciated that the mounting blade structure 144 enables the extension 140 to be secured to mounting slots 146 on a left side of the base 48 and to slots (not shown) on the right side of the base 48 such that the same abrasive extension 130 may be secured to either side.

Exemplary Abrasive Extension

Figure 7:
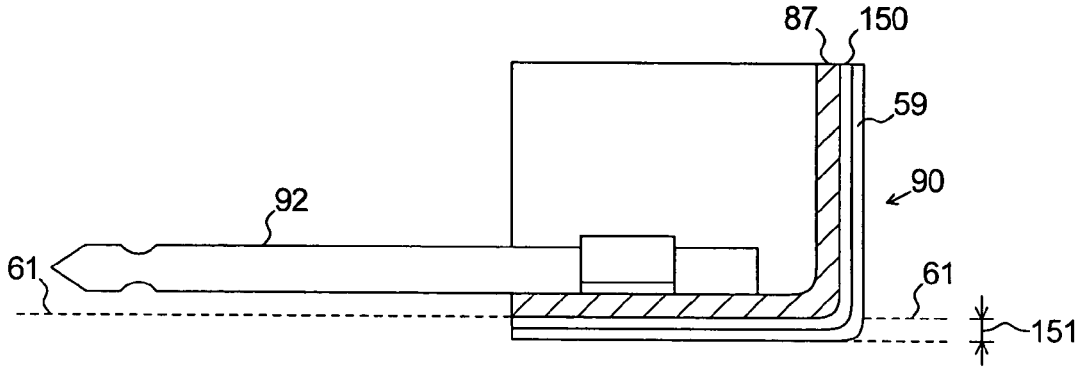
FIG. 7 shows a cross section view of an exemplary abrasive extension module in attendance with one embodiment of the present invention.

Turning briefly to FIG. 7, an exemplary cross section of an abrasive extension 86 is shown. The extension 86 comprises a malleable materials 150 such as a foam or rubber positioned between the rigid frame 87 and an abrasive screen 59. The malleable material 150 is generally planar and is positioned on both the first abrasive extension surface 88 and the second abrasive extension surface 90.

FIG. 7 also represents formation of a radius at the intersection of the first abrasive extension surface 88 and the second abrasive extension surface 90. The radius is intended to facilitate: i) sanding a rounded corner; and ii) facilitate wrapping a single abrasive screen 59 around over each of the first abrasive extension surface 88 and the second abrasive extension surface 90.

It should be appreciated that although the structure shown in FIG. 7 is shown implemented on the exemplary abrasive extension 86, such structure is also useful on the abrasive extensions 130 and 140 shown in FIGS. 3 and 4 respectively.

FIG. 7 also show an embodiment wherein the first abrasive extension surface 88 positioned below the sanding plane 61 by a distance 151. This demonstrates that the rigid frame 87 may be formed such that the first abrasive extension surface 88 is positioned below the sanding surface 61 by a distance 151 when mounted to the base 48 such that there is a clearance of the distance 151 between the abrasive secured to the base 48 and the surface intended to be sanded when the extension 86 is mounted to the base.

First Alternative Bottom Perimeter

Referring again to FIG. 3, an alternative embodiment of a perimeter mesa 129 is shown extending about the perimeter of the bottom surface 52. The alternative embodiment perimeter mesa 129 may be a bristled brush and extending just below the sanding plane 61 (FIG. 1*c*) such that when sanding, the bristled brush contacts the sanding surface to "loosen" sanding dust adhered to the surface such that the dust is more easily drawing into vacuum manifold 64. It is envisioned that the bristled brush is removablely adhered to the base such that it is readily replaced by an end user of the sanding machine. This alternative embodiment perimeter mesa 129 may be implemented with the base 48 as shown in any of FIGS. 2, 3, or 4.

Second Alternative Bottom Perimeter

Referring again to FIG. 4, a second alternative embodiment of a perimeter mesa 78 is shown extending about the perimeter of the bottom surface 52. The alternative embodiment perimeter mesa 78 may include small channels 79 thourgh which air and dust about the periphery of the base 48 may be drawn into the dust collection systems discussed above. This alternative embodiment perimeter mesa 78 may be implemented with the base 48 as shown in any of FIGS. 2, 3, or 4.

In summary, it should be appreciated that the joint compound sander of the present invention provides for the collection of dust generated during sanding of joint compound and with advantages not known in present systems.

Although the invention has been shown and described with respect to certain preferred embodiments, it is obvious that equivalents and modifications will occur to others skilled in the art upon the reading and understanding of the specification. For example, the present description includes an exemplary structure for imparting a linear oscillating motion on the base (with respect to the housing). However, those skilled in the art will appreciate that many other known structures exist for imparting either a linear or an orbital oscillating motion on a base of an electric sanding machine. The present invention includes all such equivalents and modifications, and is limited only by the scope of the following claims.

What is claimed is:

1. A sanding machine for imparting an oscillating motion on an abrasive within a sanding plane and on a removable abrasive extension, the sanding machine comprising:

a hand held housing;

a base comprising:

a bottom surface defining the sanding plane;

a clamp for securing the abrasive against the bottom surface;

a mounting for securing the removable abrasive extension to the base; and a motor coupled between the hand held housing and the base for imparting the oscillating motion between the hand held housing and the base to oscillate both the abrasive and the removable abrasive extension;

wherein the bottom surface comprises a left edge and a right edge, the left edge and right edge being parallel and extending in a longitudinal direction;

wherein the mounting secures the removable abrasive extension to the base such that a first planar abrasive extension surface of the removable abrasive extension is parallel to the longitudinal direction;

wherein the removable abrasive extension comprises:

the first planer abrasive extension surface;

a second planar abrasive extension surface perpendicular to the first planar abrasive extension surface and parallel to the longitudinal direction; and a rigid frame coupling the first planar abrasive extension surface and the second planar abrasive extension surface to the base; and whereby the first planar abrasive extension surface and the second planar abrasive extension surface oscillate with the base.

2. The sanding machine of claim 1, wherein the removable abrasive extension includes a malleable layer positioned between the rigid frame and an abrasive on each of the first planar abrasive extension surface and the second planar abrasive extension surface.

3. A sanding machine for imparting an oscillating motion on an abrasive within a sanding plane and on a removable abrasive extension, the sanding machine comprising:

a hand held housing;

a base comprising:

a bottom surface defining the sanding plane;

a clamp for securing the abrasive against the bottom surface;

a mounting for securing the removable abrasive extension to the base; and a motor coupled between the hand held housing and the base for imparting the oscillating motion between the hand held housing and the base to oscillate both the abrasive and the removable abrasive extension;

wherein the bottom surface comprises a left edge and a right edge, the left edge and the right edge being parallel and extending in a longitudinal direction, and the mounting comprises a left edge mounting for securing the removable abrasive extension adjacent to the left edge and a right edge mounting for securing the removable abrasive extension adjacent to the right edge;

wherein the mounting secures the removable abrasive extension to the base such that a first planar abrasive extension surface of the removable abrasive extension is parallel to the longitudinal direction;

wherein the removable abrasive extension comprises:

the first planar abrasive extension surface;

a second planar abrasive extension surface perpendicular to the first planar abrasive extension surface;

a rigid frame coupling the first planar abrasive extension surface and the second planar abrasive extension surface to the base; and whereby the first planar abrasive extension surface and the second planar abrasive extension surface oscillate with the base.

4. The sanding machine of claim 3, wherein the removable abrasive extension includes a malleable layer positioned between the rigid frame and an abrasive on each of the first planar abrasive extension surface and the second planar abrasive extension surface.

5. A sanding machine for imparting an oscillating motion on an abrasive within a sanding plane and on a removable abrasive extension, the sanding machine comprising:

a hand held housing;

a base comprising:

a bottom surface defining the sanding plane;

a clamp for securing the abrasive against the bottom surface;

a mounting for securing the removable abrasive extension to the base; and a motor coupled between the hand held housing and the base for imparting the oscillating motion between the hand held housing and the base to oscillate both the abrasive and the removable abrasive extension; wherein the bottom surface comprises a left edge and a right edge, the left edge and the right edge being parallel and defining a longitudinal direction, and the mounting secures the removable abrasive extension such that each of a first planar abrasive extension surface and a second planar abrasive extension surface, positioned perpendicular to each other, are each positioned parallel to the longitudinal direction.

6. The sanding machine of claim 5, further comprising the removable abrasive extension and wherein the removable abrasive extension comprises a rigid frame:

coupling the first planar abrasive extension surface and the second planar abrasive extension surface to the base; and whereby each of the first planar abrasive extension surface and the second planar abrasive extension surface oscillate with the base.

7. The sanding machine of claim 6, wherein the removable abrasive extension includes a malleable layer positioned between the rigid frame and an abrasive on each of the first planar abrasive extension surface and the second planar abrasive extension surface.

8. The sanding machine of claim 5, wherein the mounting comprises a left edge portion for securing the removable abrasive extension adjacent to the left edge and a right edge portion for securing the removable abrasive extension adjacent to the right edge.

9. The sanding machine of claim 8, further comprising the removable abrasive extension and wherein the removable abrasive extension comprises a rigid frame:

coupling the first planar abrasive extension surface and the second planar abrasive extension surface to the base; and whereby each of the first planar abrasive extension surface and the second planar abrasive extension surface oscillate with the base.

10. The sanding machine of claim 9, wherein the removable abrasive extension includes a malleable layer positioned between the rigid frame and an abrasive on each of the first planar abrasive extension surface and the second planar abrasive extension surface.

* * * * *